US011390516B2

(12) United States Patent
Koo

(10) Patent No.: US 11,390,516 B2
(45) Date of Patent: Jul. 19, 2022

(54) TAP ASSEMBLY

(71) Applicant: ILLINOIS TOOL WORKS INC., Glenview, IL (US)

(72) Inventor: Yeong-Heng Koo, Auckland (NZ)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/314,901

(22) Filed: May 7, 2021

(65) Prior Publication Data

US 2021/0347630 A1 Nov. 11, 2021

Related U.S. Application Data

(60) Provisional application No. 63/164,868, filed on Mar. 23, 2021, provisional application No. 63/082,793, filed on Sep. 24, 2020, provisional application No. 63/021,839, filed on May 8, 2020.

(51) Int. Cl.
*B67D 3/04* (2006.01)
*B65D 75/58* (2006.01)

(52) U.S. Cl.
CPC ..... *B67D 3/043* (2013.01); *B65D 75/5872* (2013.01)

(58) Field of Classification Search
CPC ..... B67D 3/043; B65D 75/5872
See application file for complete search history.

(56) References Cited

U.S. PATENT DOCUMENTS

| | | | |
|---|---|---|---|
| 4,440,316 | A | 4/1984 | Christine |
| 6,196,263 | B1 | 3/2001 | Woodruff et al. |
| 6,571,994 | B1 | 6/2003 | Adams et al. |
| 6,702,161 | B2 | 3/2004 | Adams et al. |

(Continued)

FOREIGN PATENT DOCUMENTS

| | | |
|---|---|---|
| EP | 0 432 070 A1 | 6/1991 |
| EP | 1 322 523 B1 | 11/2008 |

(Continued)

OTHER PUBLICATIONS

EPO, English language version of the International Search Report, Form PCT/ISA/210 for International Application PCT/US2021/031500, dated Jul. 27, 2021 (4 pages).

(Continued)

*Primary Examiner* — Jeremy Carroll
(74) *Attorney, Agent, or Firm* — Pauley Erickson & Swanson

(57) ABSTRACT

A tap assembly for dispensing fluid from a flexible container includes a gland for connecting with the container, the gland having an inlet and an outlet. A tap is in fluid communication with the outlet of the gland. An incision device is fixed with respect to the tap to rotate with a corresponding rotation of the tap, the incision device located at the inlet of the gland, and positioned fully within the gland in a first rotational position and generally outside of the gland in a second rotational position. An indent and/or rib and/or molded sidewall is positioned on the gland or the tap and a corresponding detent and/or rib and/or tap flange is positioned on an opposite of the tap or the gland such that the tap is rotatable between the first rotational position and the second rotational position and the indent and the detent and/or molded sidewall prevents further rotation.

22 Claims, 16 Drawing Sheets

(56) References Cited

U.S. PATENT DOCUMENTS

| | | | | |
|---|---|---|---|---|
| 7,140,520 | B1 | 11/2006 | Rutler | |
| 7,207,465 | B2 * | 4/2007 | Weist | B65D 5/748 222/83 |
| 7,261,226 | B2 | 8/2007 | Adams et al. | |
| 7,980,424 | B2 | 7/2011 | Johnson | |
| 8,075,189 | B2 | 12/2011 | Berman | |
| 8,276,748 | B2 | 10/2012 | Nyambi et al. | |
| 8,443,969 | B2 | 5/2013 | Nyambi et al. | |
| 8,602,387 | B2 | 12/2013 | Wrigley et al. | |
| 8,695,833 | B2 | 4/2014 | Barron | |
| 8,714,380 | B2 | 5/2014 | Casale et al. | |
| 8,720,744 | B2 | 5/2014 | Barron | |
| 8,967,430 | B2 | 3/2015 | Wrigley | |
| 9,394,088 | B2 | 7/2016 | Bellmore et al. | |
| 9,415,908 | B2 | 8/2016 | Barron | |
| 9,592,940 | B2 | 3/2017 | Nyambi et al. | |
| 9,623,996 | B2 | 4/2017 | Casale et al. | |
| 9,862,531 | B2 | 1/2018 | Johnson | |
| 9,862,533 | B2 | 1/2018 | Stever et al. | |
| 9,862,588 | B2 | 1/2018 | Johnson | |
| 10,179,677 | B2 | 1/2019 | Stever | |
| 10,280,062 | B2 | 5/2019 | Stever et al. | |
| 10,287,081 | B2 | 5/2019 | Stever | |
| 10,301,096 | B2 | 5/2019 | Stever et al. | |
| 10,392,157 | B2 | 8/2019 | Barron | |
| 10,676,261 | B2 * | 6/2020 | Berge | B65D 5/748 |
| 2006/0071000 | A1 * | 4/2006 | Weist | B65D 51/2835 220/521 |
| 2013/0285364 | A1 | 10/2013 | Johnson | |
| 2017/0121168 | A1 | 5/2017 | Johnson | |
| 2018/0029774 | A1 | 2/2018 | Stever | |
| 2019/0256341 | A1 | 8/2019 | Stever et al. | |
| 2022/0041426 | A1 * | 2/2022 | Nini | B67D 3/043 |

FOREIGN PATENT DOCUMENTS

| | | | |
|---|---|---|---|
| EP | 1 465 830 | B1 | 10/2011 |
| EP | 2 038 180 | B1 | 12/2011 |
| EP | 2 325 103 | B1 | 9/2012 |
| EP | 2 125 554 | B1 | 10/2013 |
| EP | 2 616 347 | B1 | 12/2014 |
| EP | 2 874 892 | B1 | 5/2015 |
| EP | 2 616 348 | B1 | 8/2015 |
| EP | 2 701 983 | B1 | 6/2016 |
| EP | 3 048 064 | B1 | 10/2017 |
| EP | 3 529 166 | A1 | 8/2019 |
| EP | 2 424 783 | B1 | 3/2020 |
| WO | WO 2008/014605 | A1 | 2/2008 |
| WO | WO 2016/201226 | A1 | 12/2016 |
| WO | WO 2016/201421 | A1 | 12/2016 |
| WO | WO 2017/007804 | A1 | 1/2017 |
| WO | WO 2018/075184 | A1 | 4/2018 |
| WO | WO 2018/215639 | A1 | 11/2018 |

OTHER PUBLICATIONS

EPO, English language version of the Written Opinion of the ISA, Form PCT/ISA/237 for International Application PCT/US2021/031500, dated Jul. 27, 2021 (5 pages).

* cited by examiner

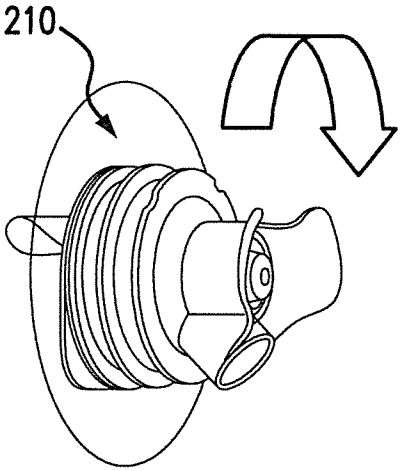
FIG. 15A
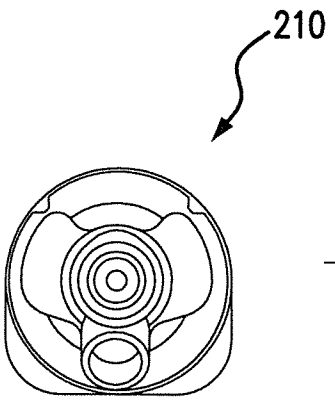
FIG. 15B
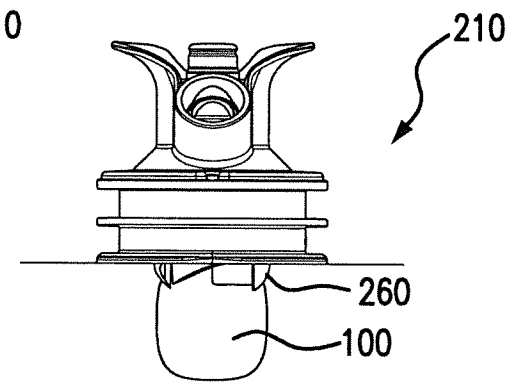
FIG. 15C
FIG. 16A
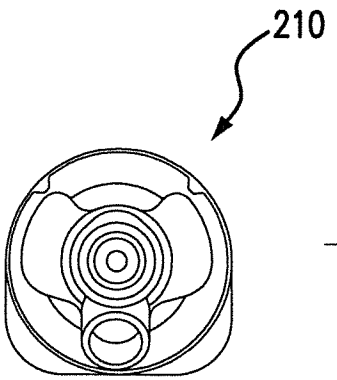
FIG. 16B
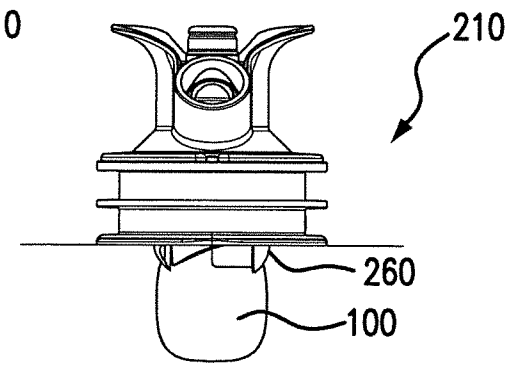
FIG. 16C

TAP ASSEMBLY

CROSS REFERENCE TO RELATED APPLICATIONS

This application claims the benefit of U.S. Provisional Application Ser. No. 63/021,839, filed on 8 May 2020; Ser. No. 63/0825,763, filed on 24 Sep. 2020; and Ser. No. 63/164,868, filed on 23 Mar. 2021. Each U.S. Provisional Application is hereby incorporated by reference herein in their entirety and are made a part hereof, including but not limited to those portions which specifically appear hereinafter.

BACKGROUND OF THE INVENTION

Field of the Invention

This invention relates to a tap assembly including a pierce valve and spout for dispensing fluids from a container.

Description of Prior Art

Valves and spouts exist for use in connection with liquid containers including pouches, bags, bags in boxes or cartons. Traditional valves are integrated with the container during manufacture of the liquid and/or filling of the container. Known taps associated with similar applications have the fitments attached to the bag with a hole cut in the plastic film to allow filling the bag with the fluid through the spout/gland opening and then the dispensing fitment is attached to the gland after the fill.

A need exists for a valve and tap combination that is integrated with a container and capable of piercing and dispensing the container subsequent to manufacture. In this way, there is zero oxygen transmission to liquids in the container prior to first use thereby extending the shelf life of the product.

SUMMARY OF THE INVENTION

The present invention is directed to a tap assembly for dispensing fluid from a container, preferably a flexible pouch or bag, and includes a gland and a cooperative tap. The gland preferably connects with the container and includes an inlet and an outlet.

The tap is in fluid communication with the outlet of the gland. An actuator preferably permits a user to dispense fluid from container through the tap by creating a fluid path from the container through the gland and through the tap. A tamper evident seal may be positioned between the tap and the gland.

An incision device is fixed with respect to the tap to rotate with a corresponding rotation of the tap. The incision device is located at the inlet of the gland, and preferably positioned fully within the gland in a first rotational position and positioned generally outside of the gland in a second rotational position.

An indent is positioned on one of the gland and the tap and a corresponding detent is positioned on an opposite one of the tap and the gland. In an additional embodiment a pair of ribs may be positioned at least one in each of the gland and tap to prevent counterclockwise rotation and/or over-rotation between the tap and the gland. The tap is thus rotatable between the first rotational position and the second rotational position such that the indent and the detent and/or ribs prevent further rotation.

BRIEF DESCRIPTION OF THE DRAWINGS

The above-mentioned and other features and objects of this invention will be better understood from the following detailed description taken in conjunction with the drawings wherein:

FIG. 15A shows a side perspective view of a tap assembly in a second position;

FIG. 15B shows a front view of the tap assembly shown in FIG. 15A;

FIG. 15C shows a side view of the tap assembly shown in FIG. 15A;

FIG. 16A shows a side perspective view of a tap assembly in a second position with the tap actuated;

FIG. 16B shows a front view of the tap assembly shown in FIG. 16A;

FIG. 16C shows a side view of the tap assembly shown in FIG. 16A;

DESCRIPTION OF PREFERRED EMBODIMENTS

Figure 1A:
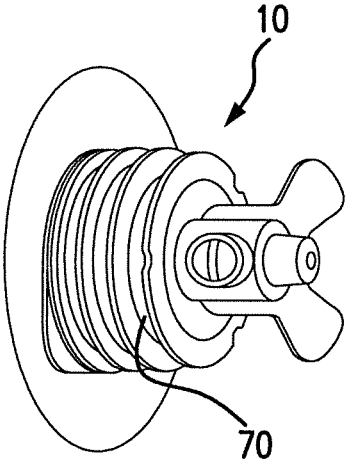
FIG. 1A shows a side perspective view of a tap assembly in a first position.

FIGS. 1-12 show a tap assembly 10 according to preferred embodiments of this invention. FIGS. 1A-1C, 2A-2C, 3A-3C and 4A-4C show three views of a tap assembly in each of four modes of operation. FIGS. 13-21 show a tap assembly 210 according to preferred embodiments of this invention. FIGS. 13A-13C, 14A-14C, 15A-15C and 16A-16C show three views of a tap assembly in each of four modes of operation.

As shown in FIGS. 1-12, a tap assembly 10 for dispensing fluid from a container includes a gland 20 for connecting with the container, the gland 20 having an inlet 25 and an outlet 30. The gland 20 may be molded of a food safe plastic and preferably includes a threaded inner body 35. The preferably extends from a container 90 at the inlet 25 to the outlet 30 thereby directing fluid flow away from the container 90.

A tap 40 is in fluid communication with the outlet 30 of the gland 20. The tap preferably includes a molded plastic body that complements the gland and may include a threaded body 45 that engages with and permit rotational engagement with the gland 20. The threading as shown in the drawings may be reversed between the gland 20 and the tap 40 if such an arrangement permits rotational movement of the tap 40 relative to the gland 20.

An incision device 60 is preferably fixed with respect to the tap 40 to rotate with a corresponding rotation of the tap 40. The incision device 60 is preferably located at the inlet 25 of the gland 20 and positioned fully within the gland 20 in a first rotational position. Following full rotation of the tap 40 relative to the gland 20 into a second rotational position, the incision device 60 is preferably positioned generally outside of the gland 20 and preferably in a fully extended position relative to the gland 20.

Figure 1B:
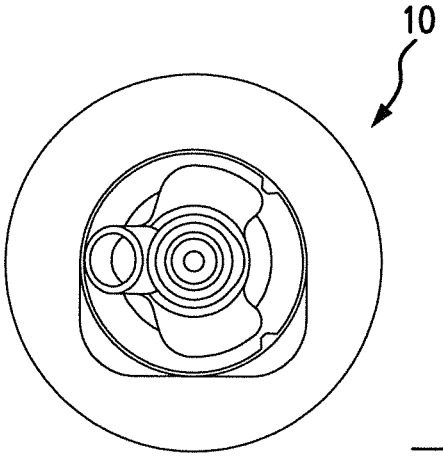
FIG. 1B shows a front view of the tap assembly shown in FIG. 1A.
Figure 1C:
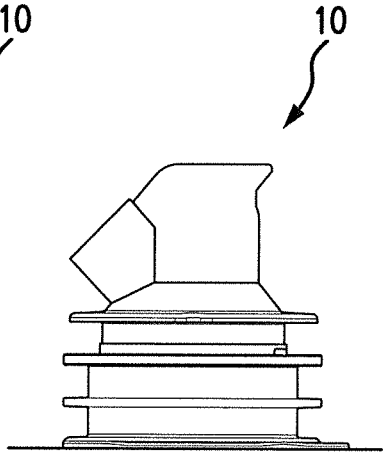
FIG. 1C shows a side view of the tap assembly shown in FIG. 1A.
Figure 2A:
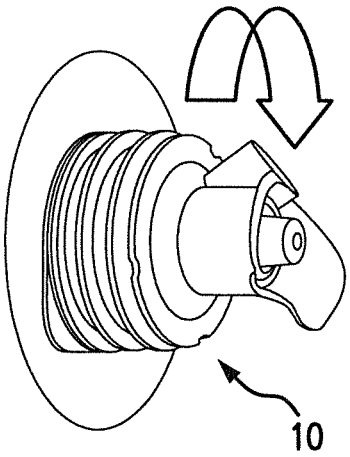
FIG. 2A shows a side perspective view of a tap assembly as the tap is rotated away from the a first position.
Figure 2B:
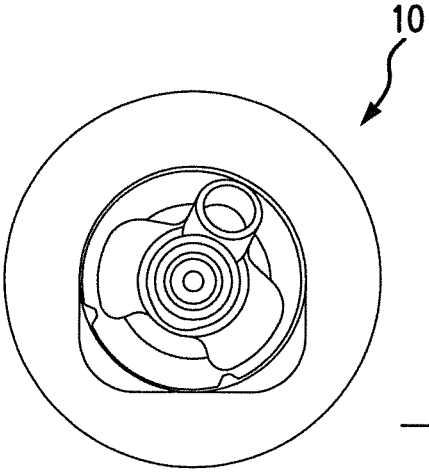
FIG. 2B shows a front view of the tap assembly shown in FIG. 2A.
Figure 2C:
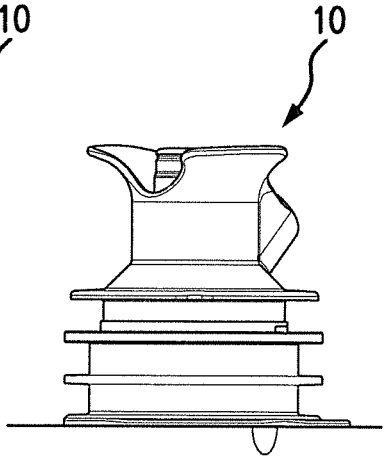
FIG. 2C shows a side view of the tap assembly shown in FIG. 2A.
Figure 3A:
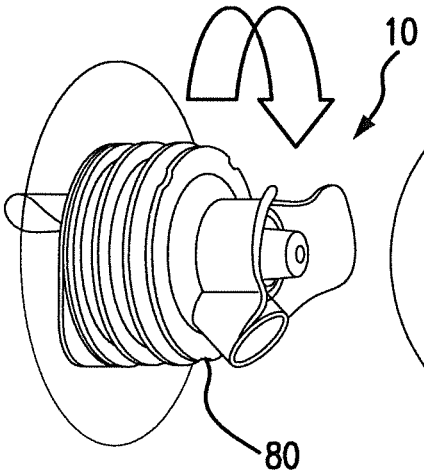
FIG. 3A shows a side perspective view of a tap assembly in a second position.
Figure 3B:
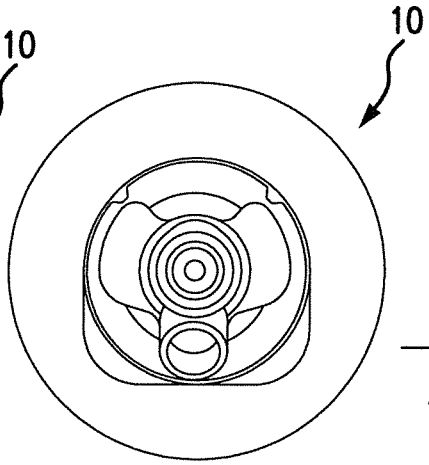
FIG. 3B shows a front view of the tap assembly shown in FIG. 3A.
Figure 3C:
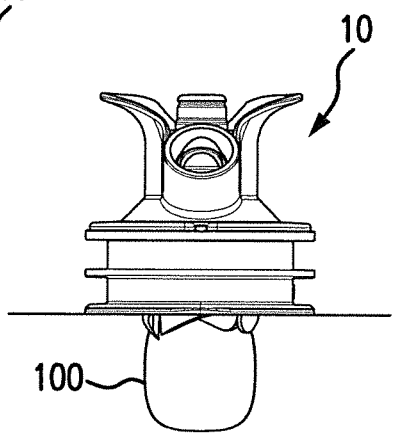
FIG. 3C shows a side view of the tap assembly shown in FIG. 3A.
Figure 4A:
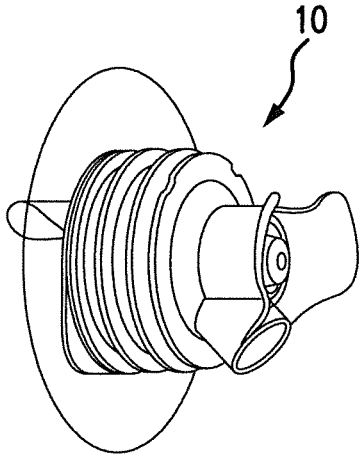
FIG. 4A shows a side perspective view of a tap assembly in a second position with the tap actuated.
Figure 4B:
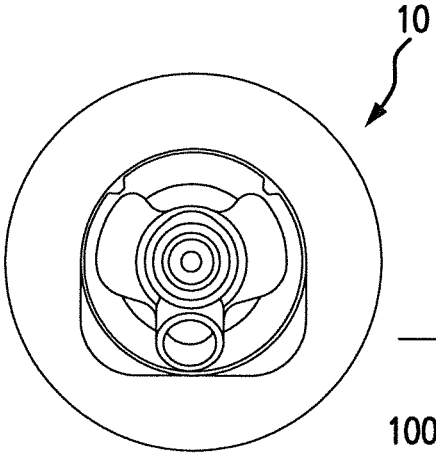
FIG. 4B shows a front view of the tap assembly shown in FIG. 4A.
Figure 4C:
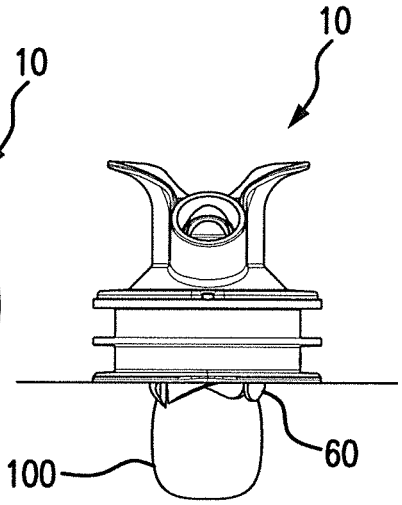
FIG. 4C shows a side view of the tap assembly shown in FIG. 4A.
Figure 5:
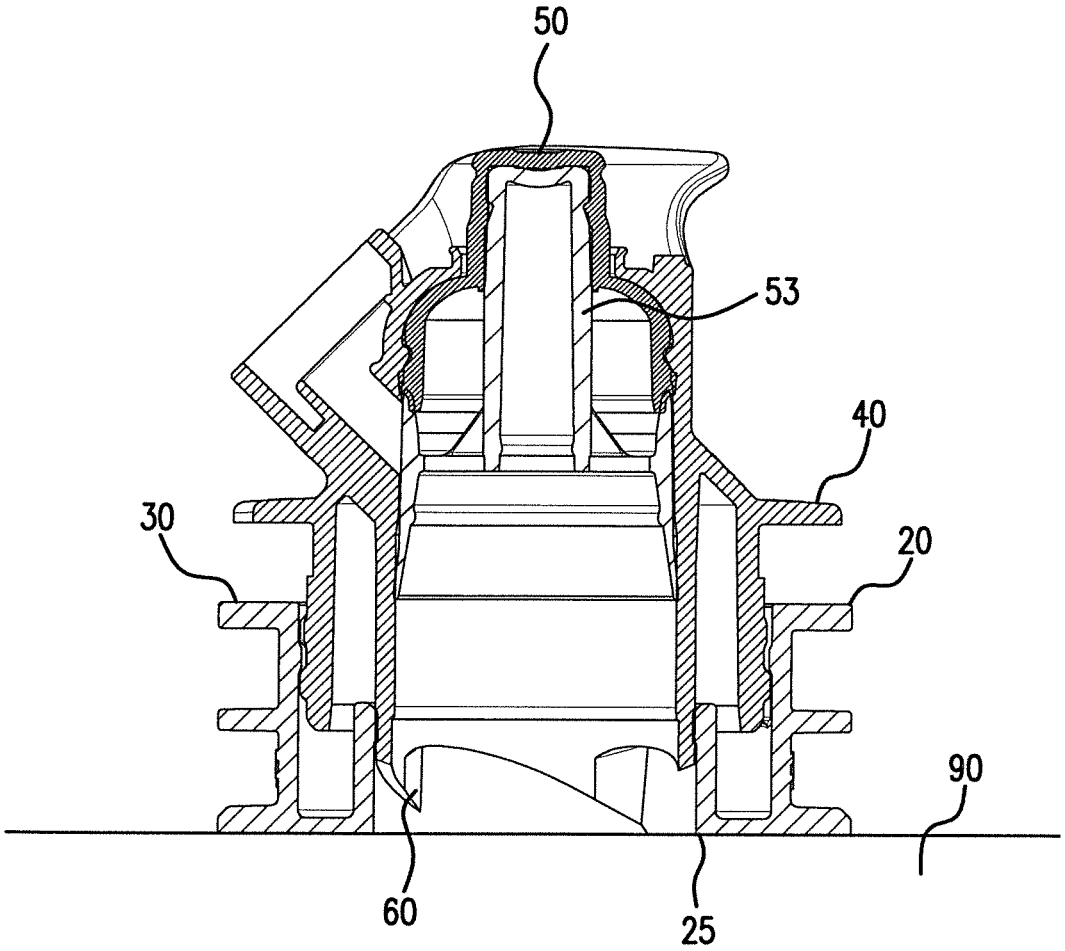
FIG. 5 shows a cross-sectional side view of a tap assembly in a first position.
Figure 6:
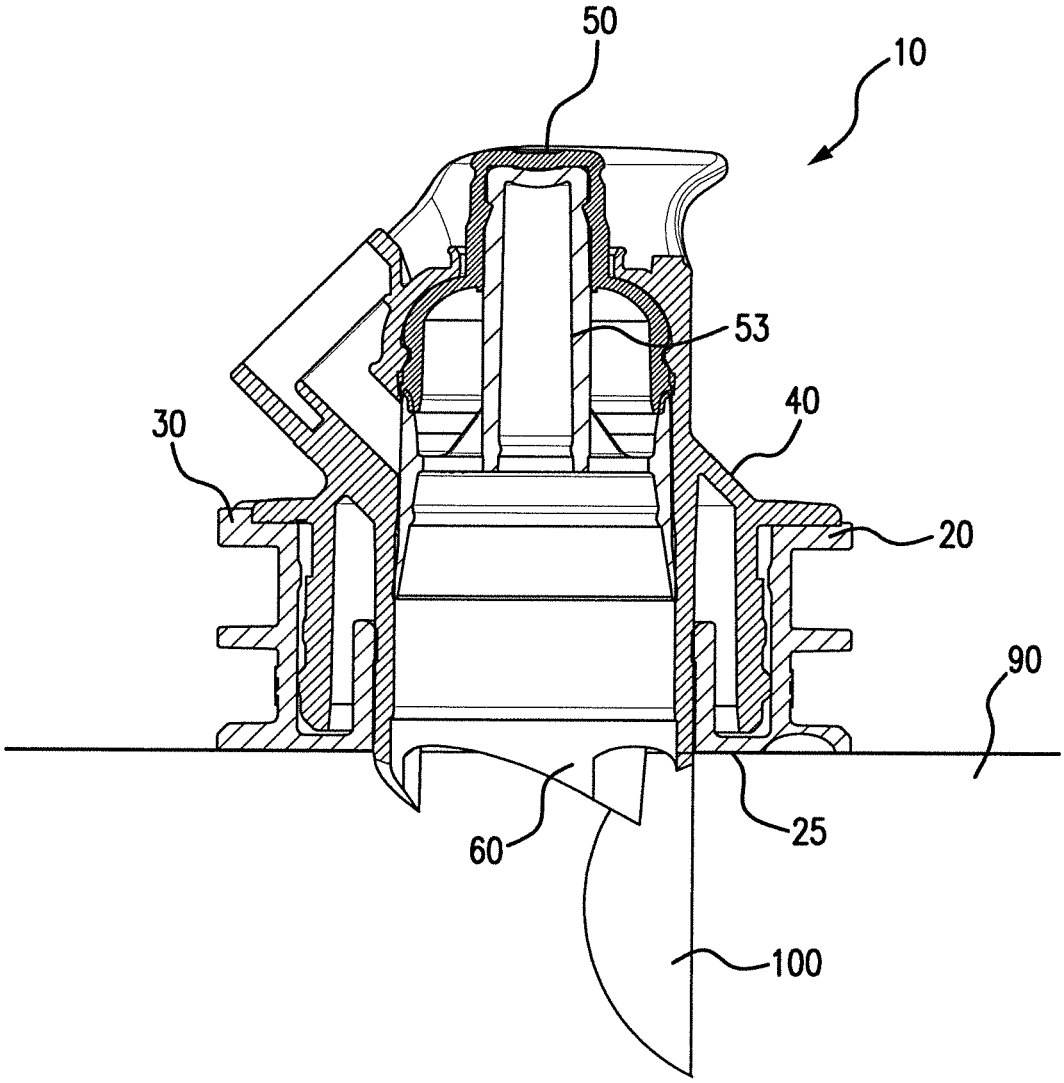
FIG. 6 shows a cross-sectional side view of a tap assembly in a second position.
Figure 7:
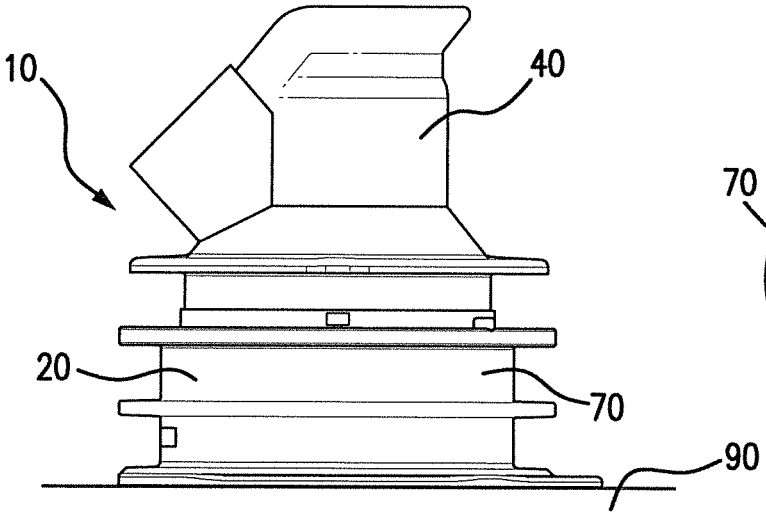
FIG. 7 shows a side view of a tap assembly in a first position.
Figure 8:
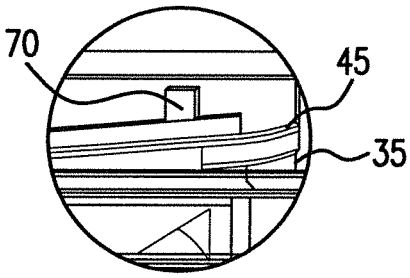
FIG. 8 shows a magnified view 8 of FIG. 7.
Figure 9:
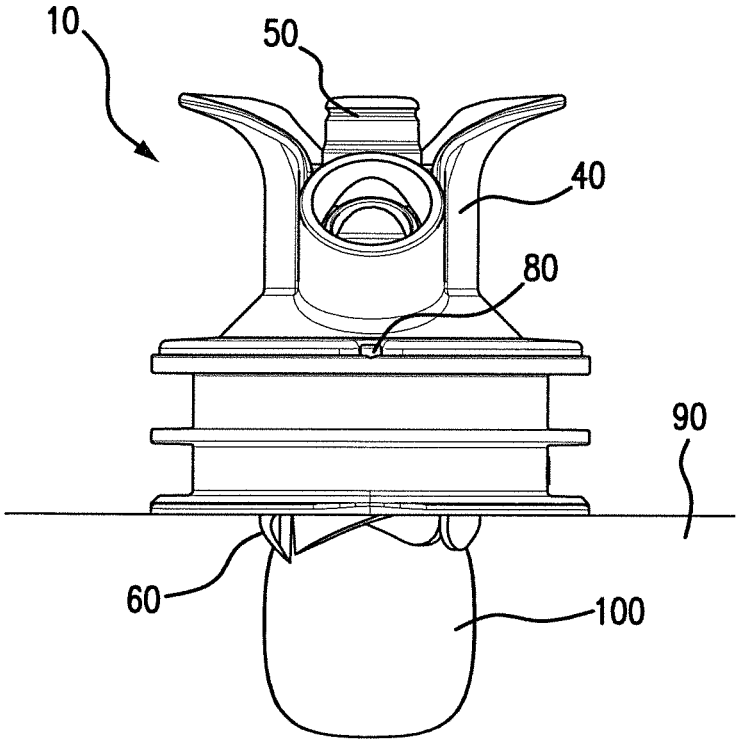
FIG. 9 shows a side view of a tap assembly in a second position.
Figure 10:
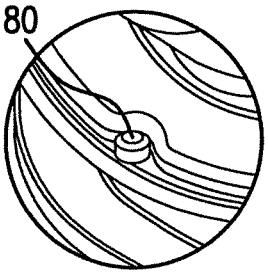
FIG. 10 shows a magnified view 10 of FIG. 9.

The rotation between the first rotational position shown in FIGS. 1A-1C, through an intermediate position shown in FIGS. 2A-2C and then to a second rotational position shown in FIGS. 3A-3C preferably simultaneously extends the incision device 60 and opens a fluid path between the gland 20 and the tap 40, and more specifically between the container 90 and the tap 40. As best shown in FIGS. 6 and 9, a flap 100 or portion of the container membrane is opened up by the incision device 60 to clear the fluid path from the container 90 to the tap 40.

An indent 70 is preferably positioned on one of either the gland 20 or the tap 40 and a corresponding detent 80 is preferably positioned on an opposite one of the tap 40 or the gland 20. The tap 40 is preferably rotatable between the first rotational position and the second rotational position such that the indent 70 and the detent 80 lock together to prevent further rotation beyond either rotational endpoint.

According to one preferred embodiment, the indent 70 is positioned 270 degrees from the detent 80 around a perimeter of the gland 20 and the tap 40. In this way, the first rotational position of the tap assembly 10 is when the tap assembly 10 is at rest and flush with an outside surface of a flexible fluid container such as a bag or pouch. Following rotation of the tap 40 relative to the gland 20 for a full 270 degrees, the incision device punctures the container and is fully extended once the indent 70 engages with the detent 80 in the second rotational position. Although identified in one preferred embodiment as 270 degrees, this rotational freedom may be more or less depending on the desired application.

The tap assembly 10 preferably includes a threaded profile with indent 70 and detent 80 to additionally prevent accidental rotation of the tap 40 or to enable tamper evidence. The threads allow for a rotary function that pierces the bag/pouch allowing the fluid to be dispensed. The tap body features the incision device 60 that is actuated when rotated into a dispensing position at the second rotational position and the act of rotating the tap into position cuts through the sterility membrane allowing the user to dispense the fluid. Once activated, the tap 40 is preferably locked into position with the indent 70 and detent 80 feature.

In a preferred embodiment of this invention wherein the flexible fluid container may be a bag or a pouch, the tap assembly 10 and specifically the gland 20 may be welded to the container 90. As described herein, the tap assembly 10 is entirely external to the container 90 and the container 90 is not breached until the tap 40 is rotated relative to the gland 20. This separation preserves the integrity of the container 90 and avoids contamination from oxygen or other external contaminants. To aid in attachment of the tap assembly 10 to the container 90, a flange 55 may be positioned at the inlet 25 of the gland 20 and is preferably generally flush with an end of the inlet 25 to form a generally planar inlet 25 of the gland 20.

The tap assembly as shown in the figures may further include a button 50 positioned at an end of the tap 40 for dispensing fluid through the gland 20. The button 50 is preferably connected with respect to an actuator 53 for opening a fluid passage between the container 90 and the tap 40.

Figure 11:
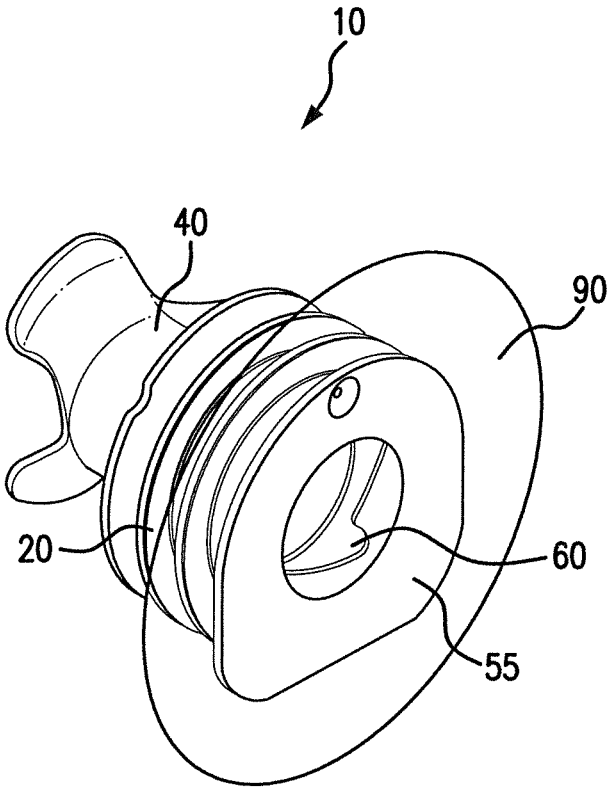
FIG. 11 shows a rear perspective view of a tap assembly in a first position.
Figure 12:
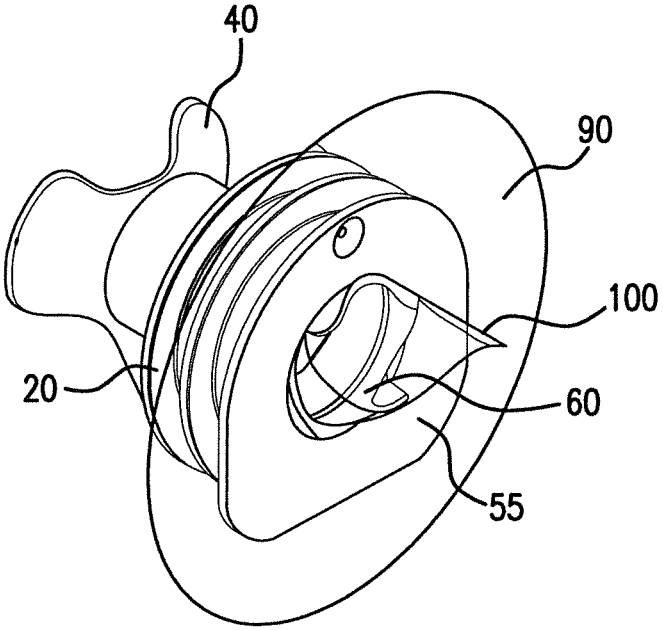
FIG. 12 shows a rear perspective view of the assembly of FIG. 11 in a second position.

According to one preferred embodiment, the incision device 60 is a curved support having a straight sharpened leading edge. The incision device 60 is preferably positioned at a bottom of the gland 20 in the first rotational position and at a top of the gland 20 in the second rotational position, as best shown in FIGS. 11 and 12.

A corresponding method for dispensing fluid from a tap assembly 10 of a flexible container 90 includes connecting a gland with an exterior surface of the flexible container, the gland having an inlet and an outlet; providing a tap in fluid communication with the outlet of the gland; fixing an incision device with respect to the tap; rotating the tap and the incision device located at the inlet of the gland, from a first rotational position fully within the gland to a second rotational position generally outside of the gland, wherein an indent positioned on one of the gland and the tap and a corresponding detent positioned on an opposite one of the tap and gland, ensures limited rotation between the first rotational position and the second rotational position; and piercing the flexible container with the incision device.

The tap assembly 10 fitment preferably is provided as a 1-piece unit (gland and tap), though a two-piece assembly is possible. The tap assembly is preferably attached to the outside of the film of the container so once the container is filled with the fluid and sealed there is no oxygen transmission, thereby prolonging the shelf life of the fluid, until the end consumer is ready to dispense the fluid for use.

As shown in FIGS. 13-21, a tap assembly 210 for dispensing fluid from a container includes a gland 220 for connecting with the container, the gland 220 having an inlet 225 and an outlet 230. The gland 220 may be molded of a food safe plastic and preferably includes a threaded inner body 235. The preferably extends from a container 90 at the inlet 225 to the outlet 230 thereby directing fluid flow away from the container 90.

A tap 240 is in fluid communication with the outlet 230 of the gland 220. The tap preferably includes a molded plastic body that complements the gland and may include a threaded body 245 that engages with and permit rotational engagement with the gland 220. The threading as shown in the drawings may be reversed between the gland 220 and the tap 240 if such an arrangement permits rotational movement of the tap 240 relative to the gland 220.

An incision device 260 is preferably fixed with respect to the tap 240 to rotate with a corresponding rotation of the tap 240. The incision device 260 is preferably located at the inlet 225 of the gland 220 and positioned fully within the gland 220 in a first rotational position. Following full rotation of the tap 240 relative to the gland 220 into a second rotational position, the incision device 260 is preferably positioned generally outside of the gland 220 and preferably in a fully extended position relative to the gland 220.

Figure 13A:
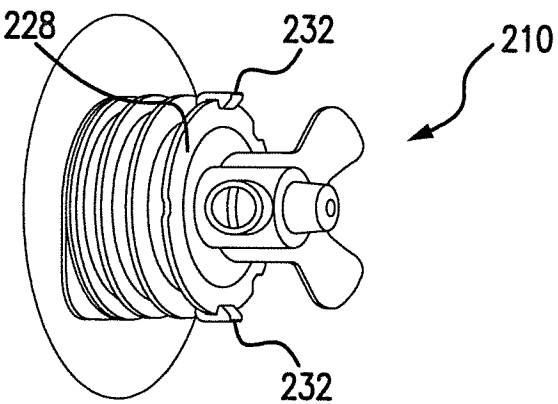
FIG. 13A shows a side perspective view of a tap assembly in a first position.
Figure 13B:
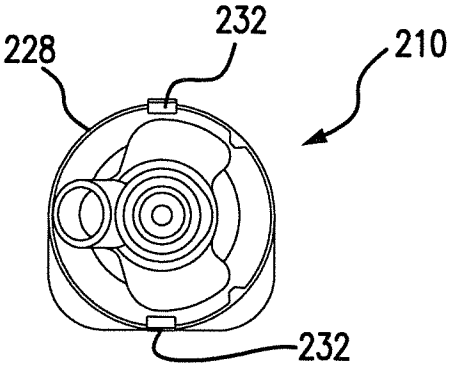
FIG. 13B shows a front view of the tap assembly shown in FIG. 13A.
Figure 13C:
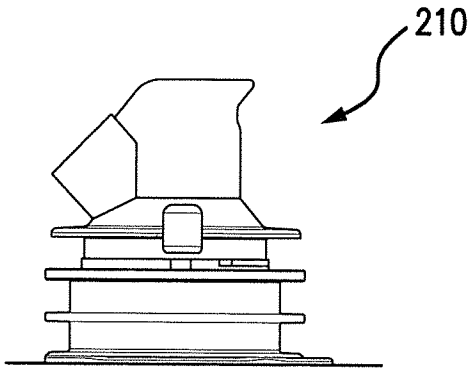
FIG. 13C shows a side view of the tap assembly shown in FIG. 13A.
Figure 14A:
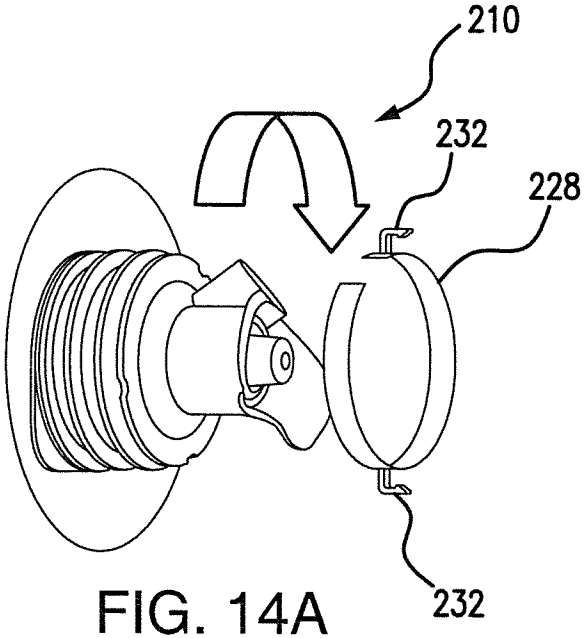
FIG. 14A shows a side perspective view of a tap assembly as the tap is rotated away from the a first position.
Figure 14B:
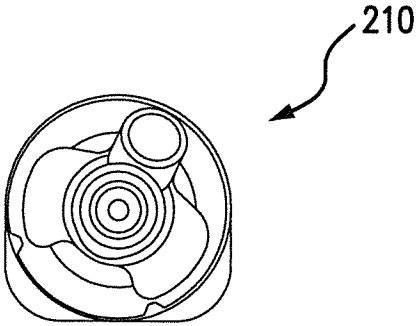
FIG. 14B shows a front view of the tap assembly shown in FIG. 14A.
Figure 14C:
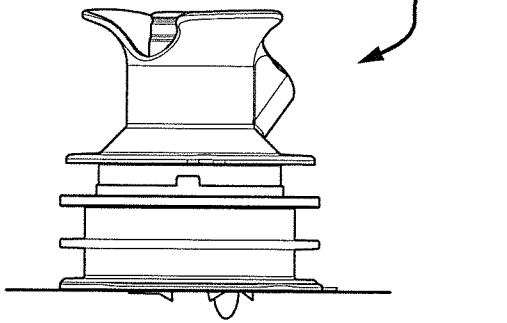
FIG. 14C shows a side view of the tap assembly shown in FIG. 14A.
Figure 17:
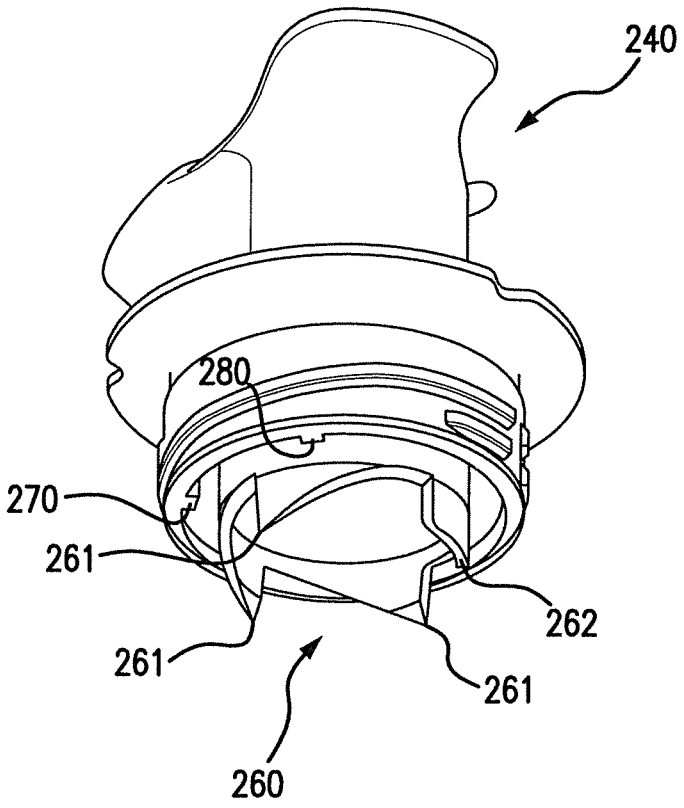
FIG. 17 shows a bottom perspective view of a tap assembly in a second position.
Figure 18:
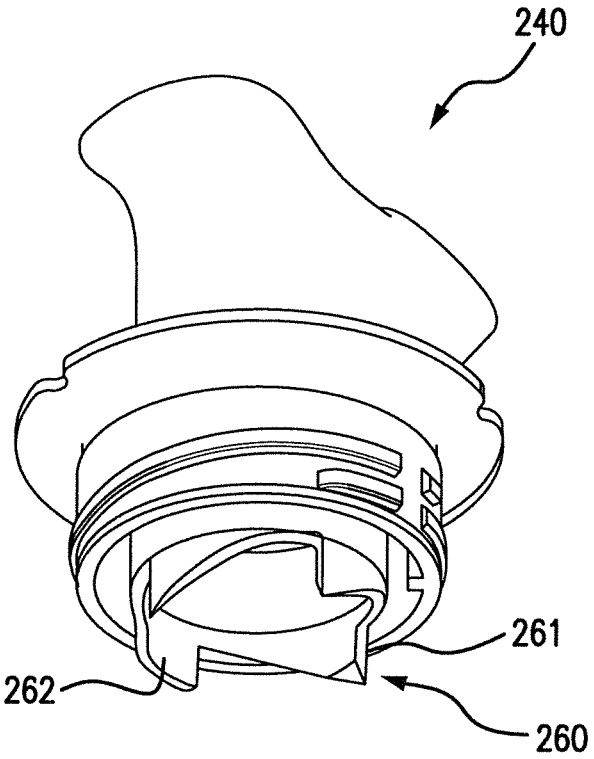
FIG. 18 shows an opposite side bottom perspective view of the tap assembly shown in FIG. 17.

The rotation between the first rotational position shown in FIGS. 13A-13C, through an intermediate position shown in FIGS. 14A-14C and then to a second rotational position shown in FIGS. 15A-15C preferably simultaneously extends the incision device 260 and opens a fluid path between the gland 220 and the tap 240, and more specifically between the container 90 and the tap 240. As best shown in FIGS. 14C, 15C and 16C, a flap 100 or portion of the container membrane is opened up by the incision device 260 to clear the fluid path from the container 290 to the tap 240.

In the closed first position of the tap assembly 210 best shown in FIGS. 13A-13C, a tamper evident band 228 may be positioned between the gland 220 and the tap 240 to prevent separation and/or rotation between the gland 220 and the tap 240 absent removal. One or more latches 232 may retain the gland 220 relative to the tap 240 in a fixed rotational position. Upon removal of the tamper evident band 228, the tap 240 may rotate relative to the gland 240.

Figure 19A:
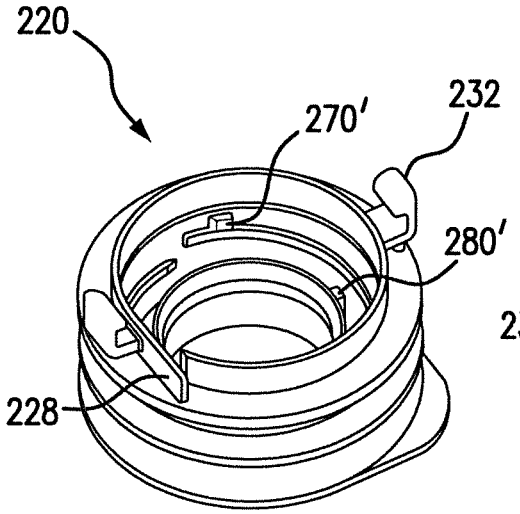
FIG. 19A shows a side perspective view of a gland assembly according to one preferred embodiment.
Figure 19B:
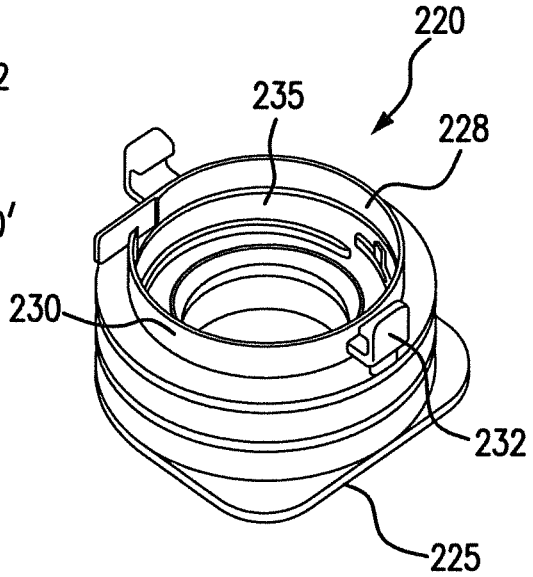
FIG. 19B shows another side perspective view of the gland assembly shown in FIG. 19A.
Figure 20A:
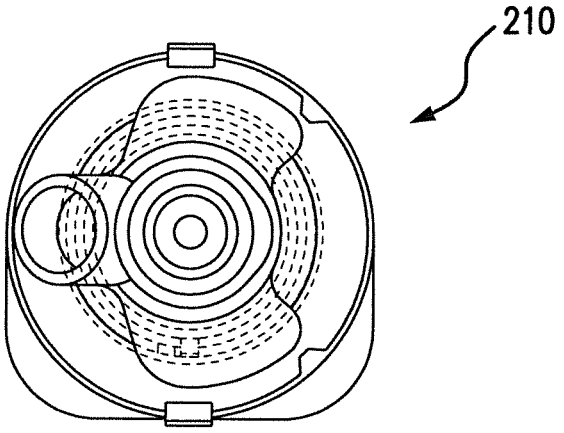
FIG. 20A shows a cross-sectional top view of a tap assembly in a first position.
Figure 20B:
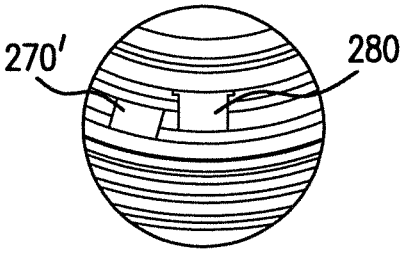
FIG. 20B shows a detail view of section A of the tap assembly in FIG. 20A.
Figure 20C:
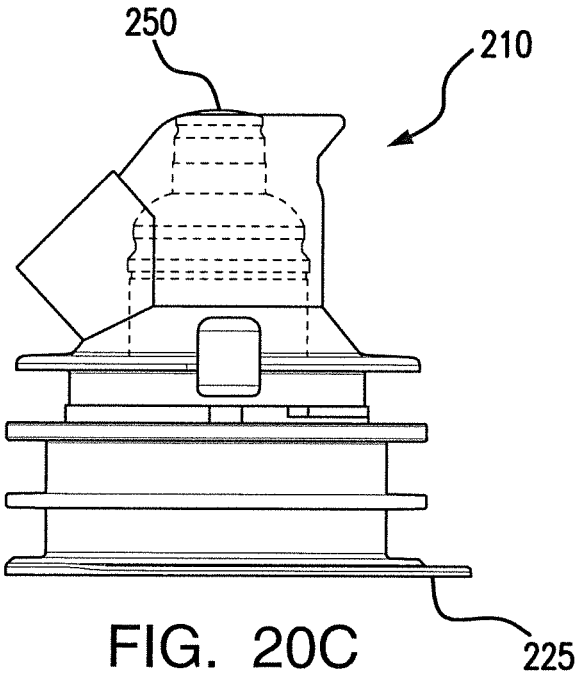
FIG. 20C shows a cross-sectional side view of the tap assembly in FIG. 20A.
Figure 21A:
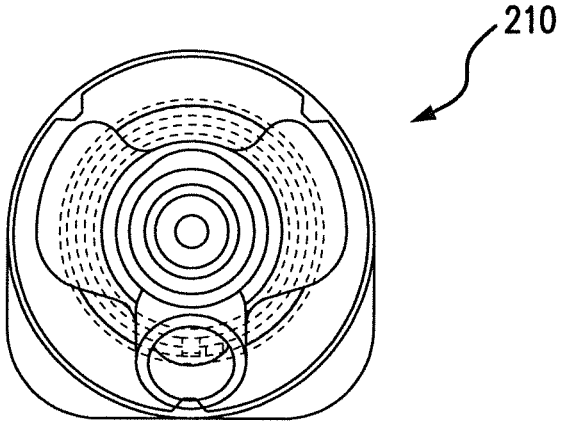
FIG. 21A shows a cross-sectional top view of a tap assembly in a second position.
Figure 21B:
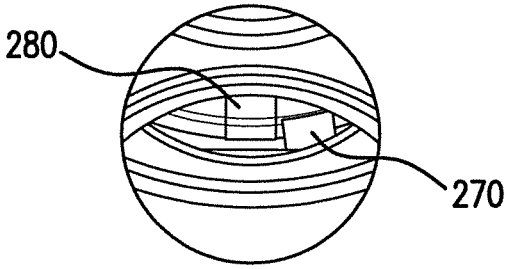
FIG. 21B shows a detail view of section A of the tap assembly in FIG. 21A.
Figure 21C:
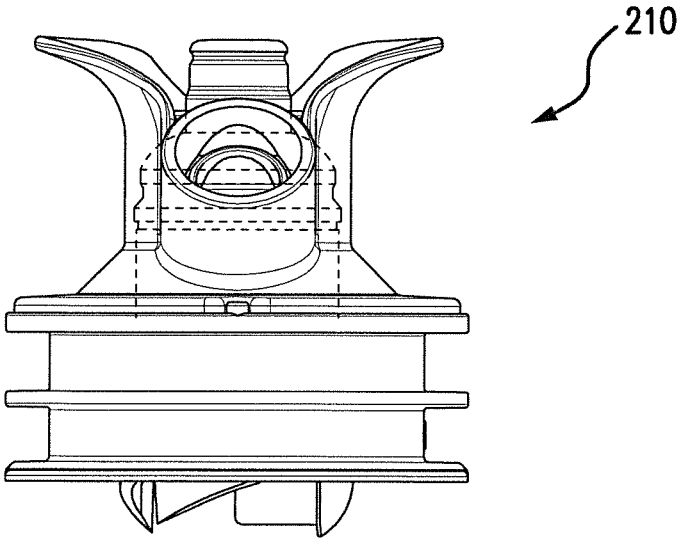
FIG. 21C shows a cross-sectional side view of the tap assembly in FIG. 21A.
Figure 22:
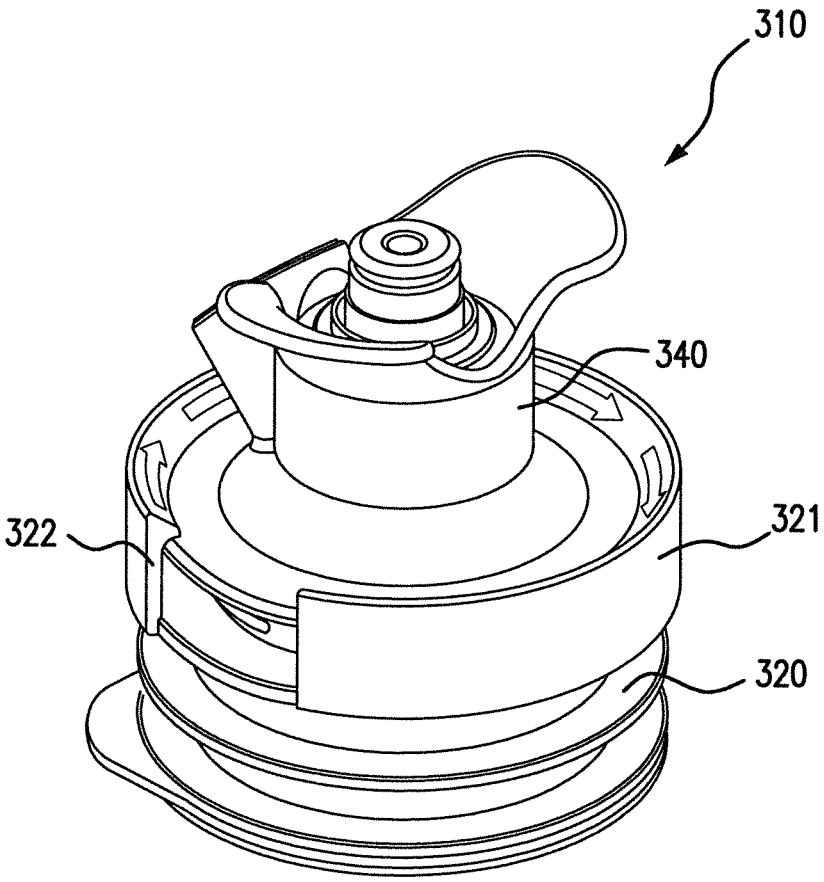
FIG. 22 shows a perspective view of a tap assembly in a closed position according to one preferred embodiment.
Figure 23:
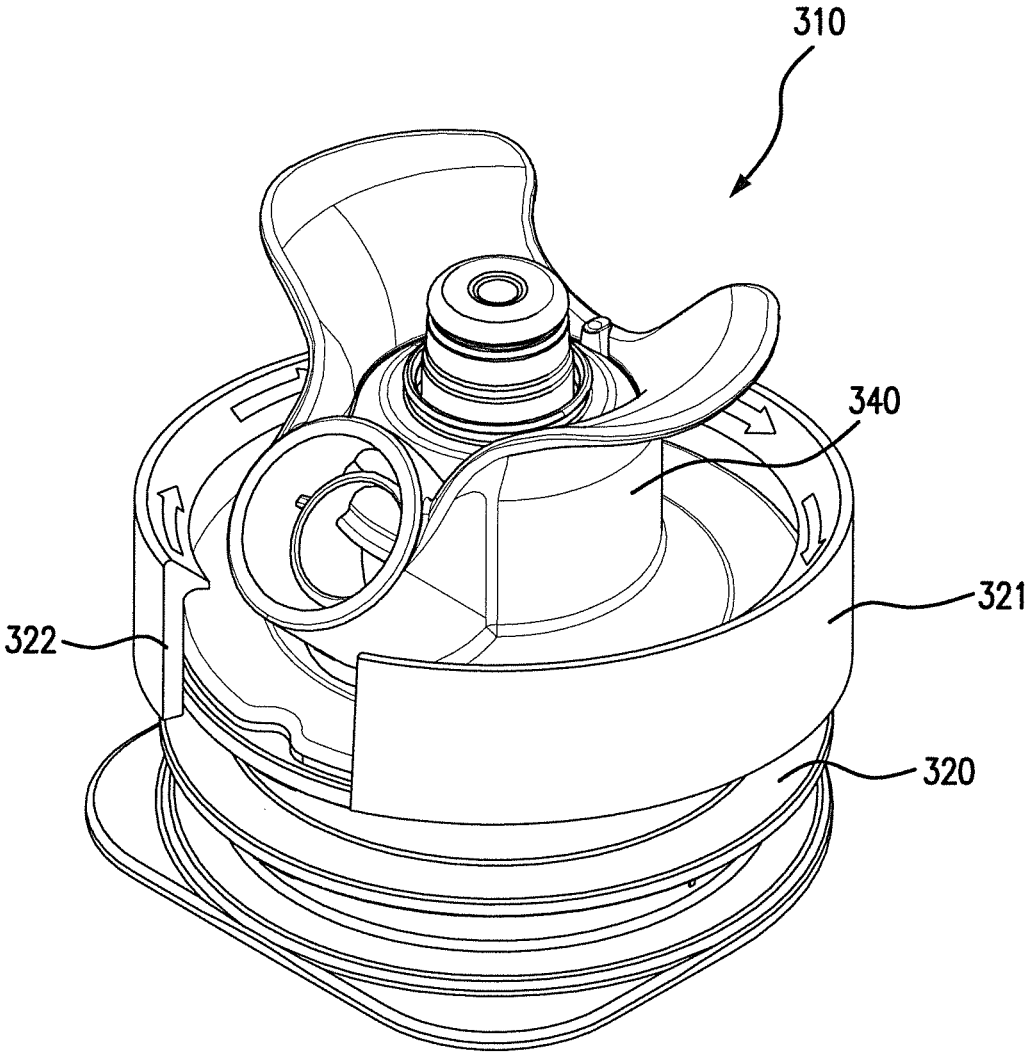
FIG. 23 shows a perspective view of the tap assembly of claim 22 in an open position.

A pair of corresponding ribs 270, 280 are preferably positioned on the gland 220 and oppositely on the tap 240. The tap 240 is preferably rotatable between the first rotational position and the second rotational position such that the ribs lock together to prevent further rotation beyond either rotational endpoint. As best shown in FIGS. 19-21, ribs 280, 280' may be positioned at a rotational interface between the tap 240 and the gland 220 to prevent counter-clockwise rotation of the tap 240 relative to the gland 220 and ribs 270, 270' are preferably also positioned at a full stop in the fully open second position, which is preferably approximately 270 degrees from the fully closed first position.

According to one preferred embodiment, a rib 270 is positioned 270 degrees from a corresponding rib 270' around a perimeter of the gland 220 and the tap 240. In this way, the first rotational position of the tap assembly 210 is when the tap assembly 210 is at rest and flush with an outside surface of a flexible fluid container such as a bag or pouch. Following rotation of the tap 40 relative to the gland 220 for a full 270 degrees, the incision device punctures the container and is fully extended once the corresponding ribs 270, 270' engage in the second rotational position. Although identified in one preferred embodiment as 270 degrees, this rotational freedom may be more or less depending on the desired application.

The tap assembly 210 preferably includes a threaded profile with a desired rib 280 to additionally prevent accidental rotation of the tap 240 or to enable tamper evidence which interferes with ribs 270, 270' on the gland 220. The threads allow for a rotary function that pierces the bag/pouch allowing the fluid to be dispensed. The tap body features the incision device 260 that is actuated when rotated into a dispensing position at the second rotational position and the act of rotating the tap into position cuts through the sterility membrane allowing the user to dispense the fluid. Once activated, the tap 240 is preferably locked into position with the rib 270, 270'.

In a preferred embodiment of this invention wherein the flexible fluid container may be a bag or a pouch, the tap assembly 210 and specifically the gland 220 may be welded to the container 90. As described herein, the tap assembly 210 is entirely external to the container 90 and the container 90 is not breached until the tap 240 is rotated relative to the gland 220. This separation preserves the integrity of the container 90 and avoids contamination from oxygen or other external contaminants. To aid in attachment of the tap assembly 210 to the container 290, a flange 255 may be positioned at the inlet 225 of the gland 220 and is preferably generally flush with an end of the inlet 225 to form a generally planar inlet 225 of the gland 220.

The tap assembly as shown in the figures may further include a button 250 positioned at an end of the tap 240 for dispensing fluid through the gland 220. The button 250 is preferably connected with respect to an actuator 253 for opening a fluid passage between the container 90 and the tap 240.

According to one preferred embodiment, the incision device 260 preferably comprises one or more curved supports each having a straight leading blade. As shown in FIGS. 13-21, the incision device 260 comprises three curved supports arranged in a generally circular path, wherein each curved support includes a straight leading sharpened edge or blade. In addition, a generally square shaped tooth, or "tucker" 262 is positioned around the perimeter of the incision device 260 to enable a flap 100 from the container 90 to be tucked into place following puncture and penetration by the tap assembly 210.

A corresponding method for dispensing fluid from a tap assembly 210 of a flexible container 90 includes connecting a gland with an exterior surface of the flexible container, the gland having an inlet and an outlet; providing a tap in fluid communication with the outlet of the gland; fixing an incision device with respect to the tap; rotating the tap and the incision device located at the inlet of the gland, from a first rotational position fully within the gland to a second rotational position generally outside of the gland, wherein an indent positioned on one of the gland and the tap and a corresponding detent positioned on an opposite one of the tap and gland, ensures limited rotation between the first rotational position and the second rotational position; and piercing the flexible container with the incision device.

FIGS. 22-25 show an additional embodiment of a tap assembly 310 wherein a collar 321 is molded into a gland 320 and positioned between the gland 320 and a tap 340 so as to maintain a connection between the gland 320 and the tap 340 during operation and thereby avoid separation. The collar 321 is preferably integrated with the gland 320 and partially encircles the tap 340 so as to permit dispensing of liquid while in the open position. Likewise, the arrangement of the collar 321 preferably discourages dispensing of liquid while in the closed position by providing an additional physical barrier around the output of the tap 340 when the tap 340 is fully retracted. In this embodiment, the collar 321 preferably supplants the latches 232 described above, although both may be used in certain applications.

As shown, a tap 340 is in fluid communication with the outlet 330 of the gland 320. The tap 340 preferably includes a molded plastic body that complements the gland 320 and may include a threaded body 345 that engages with and permit rotational engagement with the gland 320. The threading as shown in the drawings may be reversed between the gland 320 and the tap 340 if such an arrangement permits rotational movement of the tap 340 relative to the gland 320.

As shown in FIGS. 22-25, in a preferred embodiment, the gland 320 preferably includes a collar 321 comprising a sidewall 322 that extends longitudinally beyond at least a portion of the tap 340. More preferably, the sidewall 322 includes a retaining undercut 324 within which the tap 340 is positioned that prevents the tap 340 from full separation from the gland 320. More specifically, the tap 340 may include an integrally molded tap flange 342 that contacts the retaining undercut 324 to maintain a connection between the tap 340 and the gland 320.

An incision device 360 is preferably fixed with respect to the tap 340 to rotate with a corresponding rotation of the tap 340. The incision device 360 is preferably located at the inlet 325 of the gland 320 and positioned fully within the gland 320 in a first rotational position. Following full rotation of the tap 340 relative to the gland 320 into a second rotational position, the incision device 360 is preferably positioned generally outside of the gland 320 and preferably in a fully extended position relative to the gland 320.

Figure 24:
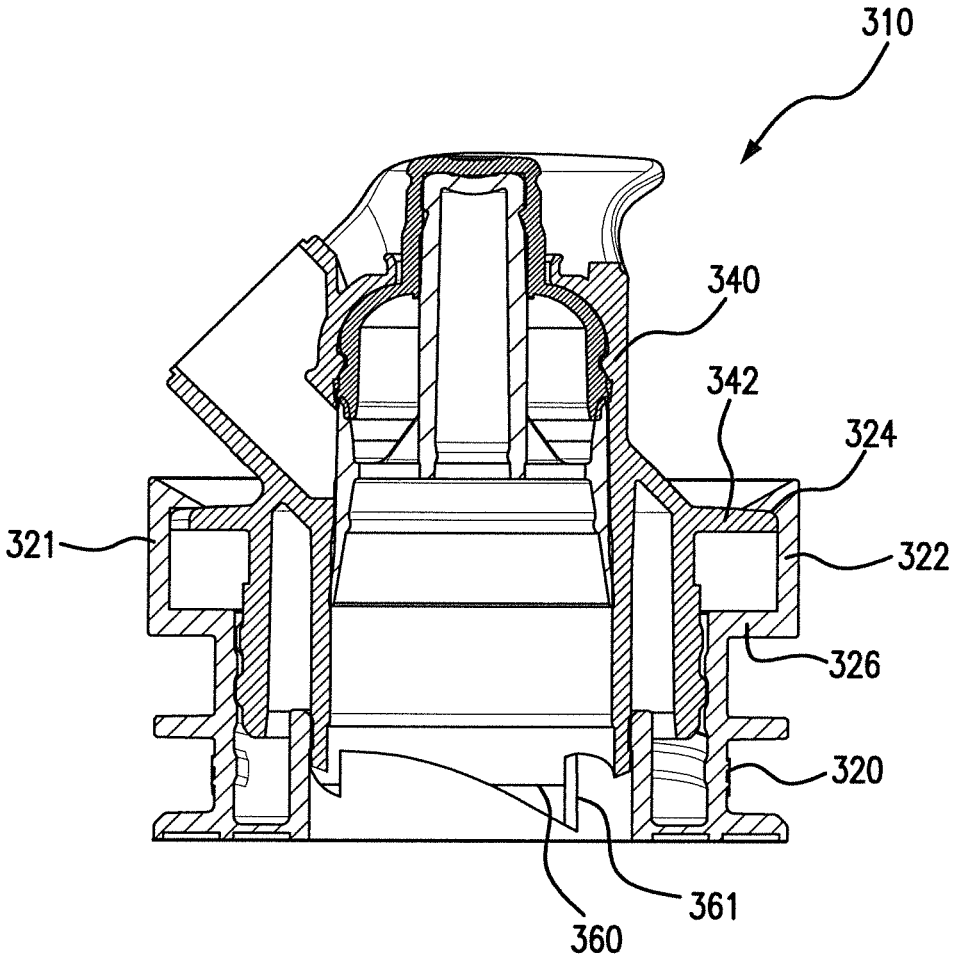
FIG. 24 shows a cross-sectional side view of the tap assembly shown in FIG. 22.
Figure 25:
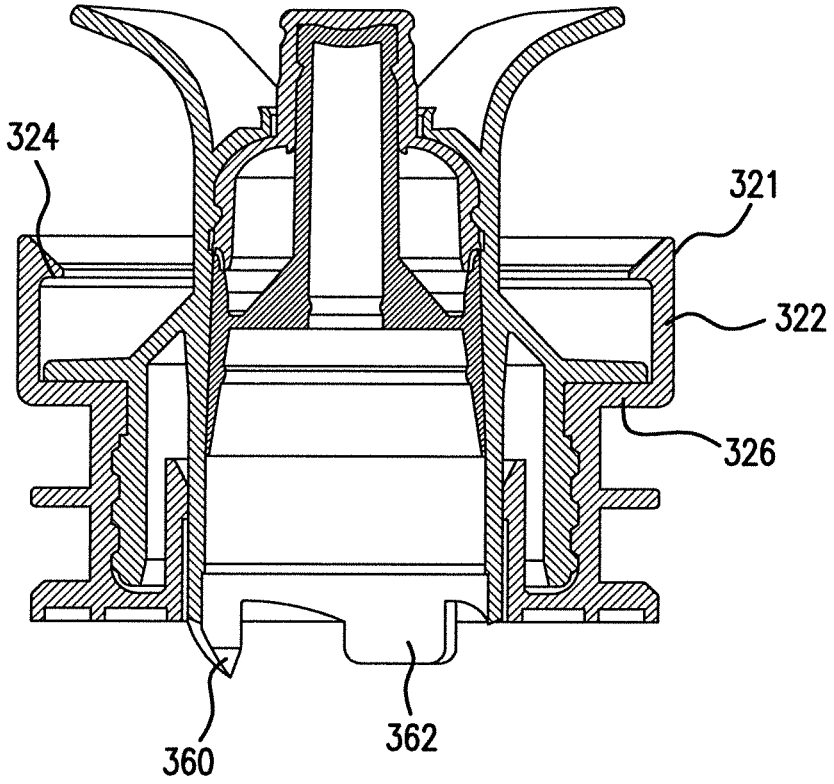
FIG. 25 shows a cross-sectional side view of the tap assembly shown in FIG. 23.

Preferably, the tap flange 342 of the tap 340 is in contact with the retaining undercut 324 when in the first rotational position as shown in FIG. 24. In addition, the tap flange 342 of the tap 340 may be in contact with a distal end 326 when in the second rational position. In this manner, two ends of the sidewall 322 preferably define a full length of travel between the first rotational position (closed) and the second rotational position (open).

Similar to the embodiments of the tap assembly 210 taught in FIGS. 13-21, the incision device 360 preferably comprises one or more and preferably three curved supports each having a straight leading blade 361. As shown in FIGS. 22-25, the incision device 360 comprises three curved supports arranged in a generally circular path, wherein each curved support includes a straight leading sharpened edge or blade. In addition, a generally square shaped tooth, or "tucker" 362 is positioned around the perimeter of the incision device 360 to enable a flap 100 from the container 90 to be tucked into place following puncture and penetration by the tap assembly 310. The tucker 362 is preferably unsharpened to facilitate tucking the flap into place within the punctured container 90.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

The invention claimed is:

1. A tap assembly for dispensing fluid from a container comprising:

a gland for connecting with the container, the gland having an inlet and an outlet;

a tap in fluid communication with the outlet of the gland;

an incision device fixed with respect to the tap to rotate with a corresponding rotation of the tap, the incision device located at the inlet of the gland, and positioned fully within the gland in a first rotational position and positioned generally outside of the gland in a second rotational position; and an indent positioned on one of the gland and the tap and a corresponding detent positioned on an opposite one of the tap and the gland, the tap rotatable between the first rotational position and the second rotational position such that the indent and the detent prevent further rotation.

2. The tap assembly of claim 1 wherein the indent is positioned 270 degrees from the detent around a perimeter of the gland and the tap.

3. The tap assembly of claim 1 wherein the container is one of a pouch and a flexible bag.

4. The tap assembly of claim 3 wherein the gland is welded to the container.

5. The tap assembly of claim 1 further comprising a button positioned at an end of the tap for dispensing fluid through the gland.

6. The tap assembly of claim 5 wherein the button is connected with respect to an actuator for opening a fluid passage between the container and the tap.

7. The tap assembly of claim 1 wherein the tap assembly is entirely external to the container and the container is not breached until the tap is rotated relative to the gland.

8. The tap assembly of claim 1 wherein the gland is threaded to the tap.

9. The tap assembly of claim 1 wherein the incision device is a curved support having a straight leading sharpened edge.

10. The tap assembly of claim 9 wherein the incision device comprises three curved supports arranged in a generally circular path, wherein each curved support includes a straight leading sharpened edge.

11. The tap assembly of claim 1 further comprising a flange positioned at the inlet of the gland and flush with an end of the inlet.

12. The tap assembly of claim 1 wherein the incision device is positioned at a bottom of the gland in the first rotational position and at a top of the gland in the second rotational position.

13. A tap assembly for dispensing fluid from a container comprising:

a gland for connecting with the container, the gland having an inlet and an outlet;

a tap in fluid communication with the outlet of the gland;

an incision device fixed with respect to the tap to rotate with a corresponding rotation of the tap, the incision device located at the inlet of the gland, and positioned fully within the gland in a first rotational position and positioned generally outside of the gland in a second rotational position; and a collar molded with respect to the gland, the collar retaining the tap relative to the gland wherein the tap is rotatable between the first rotational position and the second rotational position such that opposite ends of the collar prevent further rotation.

14. The tap assembly of claim 13 further comprising a sidewall and a retaining undercut molded into the collar, the retaining undercut maintaining attachment between the tap and the gland.

15. The tap assembly of claim 14 wherein the tap is in contact with the retaining undercut when in the first rotational position.

16. The tap assembly of claim 15 wherein the tap is in contact with a distal end of the sidewall opposite the undercut, when in the second rotational position such that two ends of the sidewall define a full length of travel between the first rotational position and the second rotational position.

17. The tap assembly of claim 14 wherein the tap includes an integrally molded tap flange.

18. The tap assembly of claim 13 wherein the incision device comprises three curved supports arranged in a generally circular path, wherein each curved support includes a straight leading sharpened edge.

19. The tap assembly of claim 18 wherein the incision device further comprises a generally square shaped tooth positioned along the generally circular path.

20. The tap assembly of claim 19 wherein the generally square shaped tooth is unsharpened.

21. A method for dispensing fluid from a tap assembly of a flexible container comprising:

connecting a gland with an exterior surface of the flexible container, the gland having an inlet and an outlet;

providing a tap in fluid communication with the outlet of the gland;

fixing an incision device with respect to the tap;

rotating the tap and the incision device located at the inlet of the gland, from a first rotational position fully within the gland to a second rotational position generally outside of the gland, wherein an indent positioned on one of the gland and the tap and a corresponding detent positioned on an opposite one of the tap and gland, ensures limited rotation between the first rotational position and the second rotational position; and piercing the flexible container with the incision device.

22. A tap assembly for dispensing fluid from a container comprising:

a gland for connecting with the container, the gland having an inlet and an outlet;

a tap in fluid communication with the outlet of the gland;

an incision device fixed with respect to the tap to rotate with a corresponding rotation of the tap, the incision device located at the inlet of the gland, and positioned fully within the gland in a first rotational position and positioned generally outside of the gland in a second rotational position; and a collar molded along the tap having a sidewall with two opposite ends that together define a length of travel between the tap and the gland wherein the tap is rotatable between the first rotational position and the second rotational position such that the two opposite ends prevent further rotation.

* * * * *